US008403696B2

(12) United States Patent
Katayanagi et al.

(10) Patent No.: US 8,403,696 B2
(45) Date of Patent: Mar. 26, 2013

(54) CONNECTOR WITH A CONDUCTIVE SHELL WITH A FLANGE WITH AN INTEGRAL LOCKING PORTION FOR ENGAGEMENT WITH A MATING CONNECTOR

(75) Inventors: Masayuki Katayanagi, Tokyo (JP); Yohei Yokoyama, Tokyo (JP); Ryouji Sugii, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/925,161

(22) Filed: Oct. 14, 2010

(65) Prior Publication Data

US 2011/0097922 A1 Apr. 28, 2011

(30) Foreign Application Priority Data

Oct. 22, 2009 (JP) ..... 2009-243677

(51) Int. Cl.
*H01R 13/627* (2006.01)

(52) U.S. Cl. ..... 439/362

(58) Field of Classification Search ..... 439/362, 439/352, 351, 355, 361, 363, 364, 366
See application file for complete search history.

(56) References Cited

U.S. PATENT DOCUMENTS 4,125,312 A * 11/1978 Aimar ..... 439/470
4,215,326 A * 7/1980 Hollyday ..... 333/182
5,096,436 A * 3/1992 Noschese ..... 29/876
5,147,220 A * 9/1992 Lybrand ..... 439/567
5,244,405 A * 9/1993 Broschard et al. ..... 439/362
5,810,620 A * 9/1998 Kobayashi et al. ..... 439/607.41
5,879,173 A * 3/1999 Poplawski et al. ..... 439/138

FOREIGN PATENT DOCUMENTS

JP 04-133372 U 12/1992
JP 2544486 8/1997
JP 2004-87462 3/2004
JP 2008-177102 7/2008

OTHER PUBLICATIONS

Japanese Office Action dated Jul. 27, 2011 in Japanese Patent Application No. 2009-243677 with English translation of relevant parts.
Office Action of Chinese Patent Application No. 201010522271.5 (mailing date Aug. 9, 2012) with English translation of relevant parts.
Chinese Office Action dated Jan. 7, 2013 in Chinese Application No. 201010522271.5 with English translation.

* cited by examiner

*Primary Examiner* — Chandrika Prasad
(74) *Attorney, Agent, or Firm* — Collard & Roe, P.C.

(57) ABSTRACT

In a connector including a to-be-fitted portion for fitting to a mating connector in a first direction and a conductive shell covering the to-be-fitted portion, the shell is provided with a flange extending from a shell body in a second direction crossing the first direction and with a to-be-locked portion extending from the flange in the first direction. When attaching the connector to an attaching object, the flange is caused to face one surface of the attaching object in the first direction and the to-be-locked portion is caused to pass through the attaching object in the first direction so as to project from an opposite surface of the attaching object.

8 Claims, 11 Drawing Sheets

CONNECTOR WITH A CONDUCTIVE SHELL WITH A FLANGE WITH AN INTEGRAL LOCKING PORTION FOR ENGAGEMENT WITH A MATING CONNECTOR

This application is based upon and claims the benefit of priority from Japanese patent application No. 2009-243677, filed on Oct. 22, 2009, the disclosure of which is incorporated herein in its entirely by reference.

TECHNICAL FIELD

This invention relates to a connector and, in particular, relates to a connector having a locking structure that can lock a connected state.

BACKGROUND ART

This type of connector is disclosed in JP-A-2008-177102 (hereinafter referred to as "patent document 1"). The connector disclosed in patent document 1 has a locking structure inside a fitting portion which is adapted for fitting connection to a mating connector as a connecting object. Herein, the connector having the locking structure inside the fitting portion is called a first type of connector.

When the first type of connector is miniaturized, its locking structure is significantly reduced in size. As a result, it is difficult to maintain a sufficient mechanical strength of locking components forming the locking structure. Moreover, it is also difficult to obtain a required locking strength.

In order to increase the strength of locking components, there is also available a connector of the type having a locking structure outside a fitting portion. Herein, this type of connector is called a second type of connector. When attaching the second type of connector to an attaching object, it is necessary that the attaching object be formed with an opening which is related to the locking structure.

There is also available a connector of the type having no locking structure. Herein, this type of connector is called a third type of connector. When attaching the third type of connector to an attaching object, it is not necessary that the attaching object be formed with an opening related to the locking structure.

SUMMARY OF THE INVENTION

Here, a case is assumed where an attaching object is designed so that any of the first to third types of connectors can be attached thereto. In this case, it is necessary that the attaching object be formed with an opening adapted for the locking structure of the second type of connector.

Now, when the second type of connector is attached to the attaching object, the opening is expected to be substantially closed by the locking structure. On the other hand, when the first or third type of connector is attached to the attaching object, the opening remains in an open state. The opening remaining in such an open state has a possibility of causing various problems on the attaching object and thus is preferably as small as possible.

It is therefore an exemplary object of this invention to provide a connector that can be expected to improve the mechanical strength and the locking strength without forming a large opening in an attaching object.

Other objects of the present invention will become clear as the description proceeds.

A connector according to an exemplary aspect of the present invention includes a to-be-fitted portion for fitting to a mating connector in a first direction and a shell which is conductive and covers the to-be-fitted portion, wherein the shell includes a flange which extends in a second direction crossing the first direction and is adapted to face an attaching object in the first direction and a to-be-locked portion for engagement with the mating connector in the first direction, the to-be-locked portion extending in a direction to pass through the attaching object in the first direction.

A mating connector according to an exemplary aspect of the present invention is for connection to the connector immediately before, wherein the mating connector includes a fitting portion for fitting to the to-be-fitted portion and a locking portion for engagement with the to-be-locked portion, the locking portion located outside the fitting portion in the second direction.

A connector according to another exemplary aspect of the present invention is fixed to an attaching object, wherein the connector includes a to-be-fitted portion for fitting to a mating connector in a first direction and a shell which is conductive and covers the to-be-fitted portion, and wherein the shell includes a flange which extends in a second direction crossing the first direction and faces a surface of the attaching object in the first direction and a to-be-locked portion for engagement with the mating connector, the to-be-locked portion passing through the attaching object in the first direction to project from an opposite surface of the attaching object.

A mating connector according to another exemplary aspect of the present invention is for connection to the connector immediately before, wherein the mating connector includes a fitting portion for fitting to the to-be-fitted portion and a locking portion for engagement with the to-be-locked portion, the locking portion located outside the fitting portion in the second direction.

EXEMPLARY EMBODIMENTS

Referring to FIGS. 1 to 9, a connecting device according to a first embodiment of this invention will be described.

Figure 1:
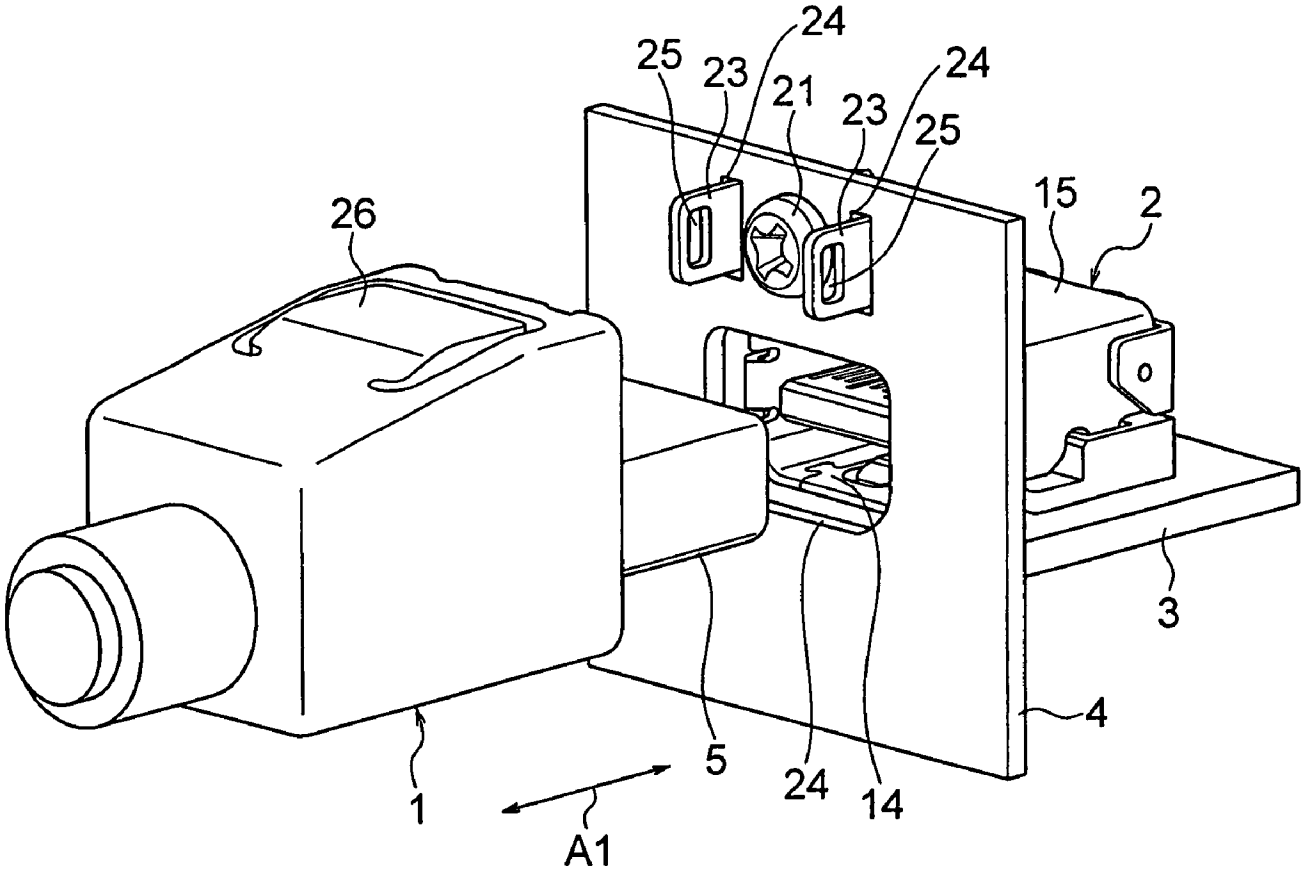
FIG. 1 is a perspective view of a connecting device according to a first embodiment of this invention.
Figure 2:
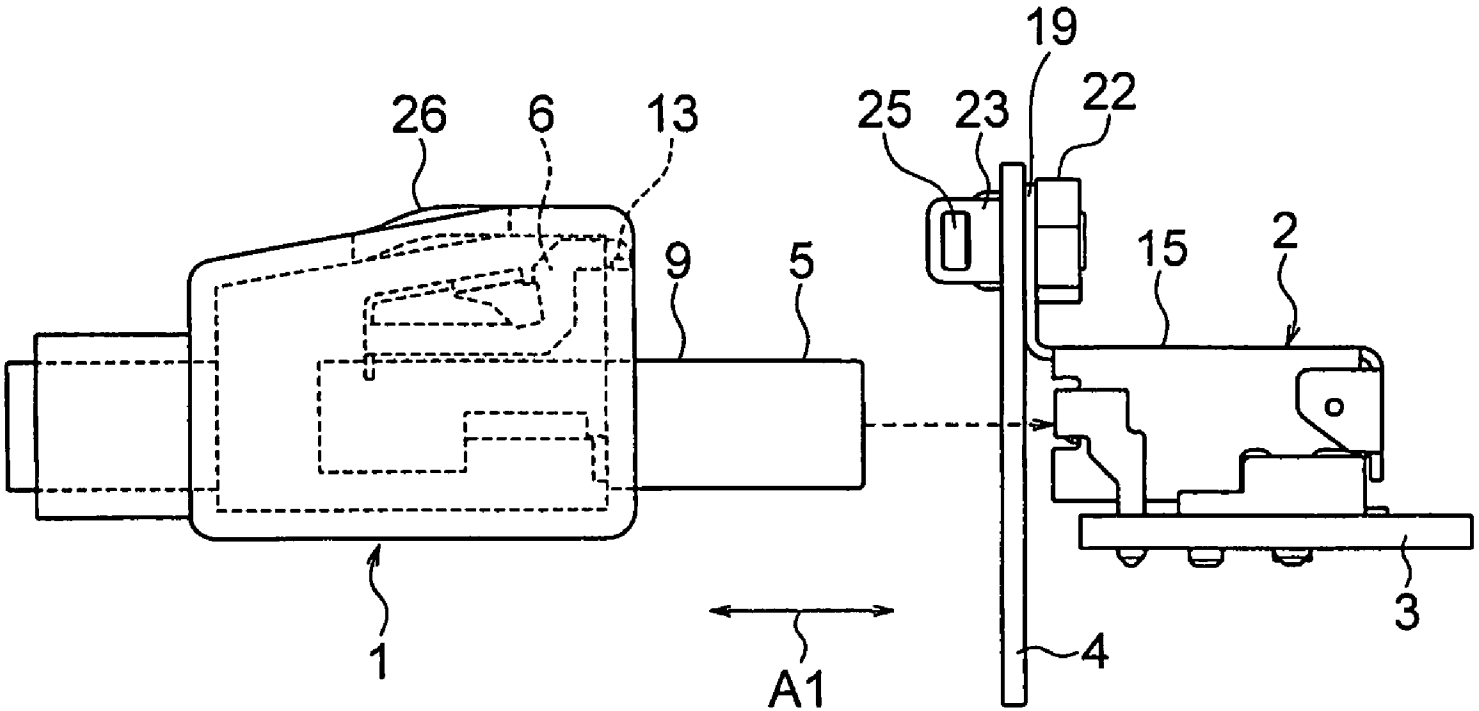
FIG. 2 is a side view of the connecting device of FIG. 1.
Figure 3:
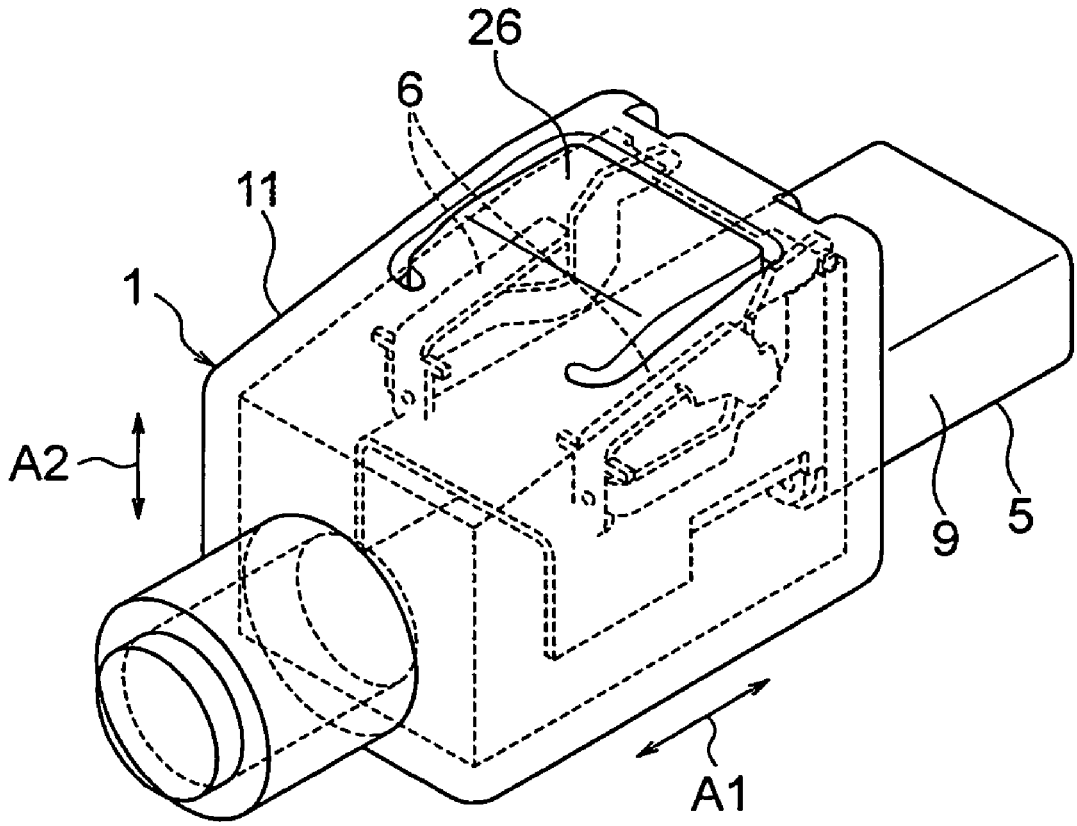
FIG. 3 is a perspective view of a plug included in the connecting device of FIG. 1.
Figure 4:
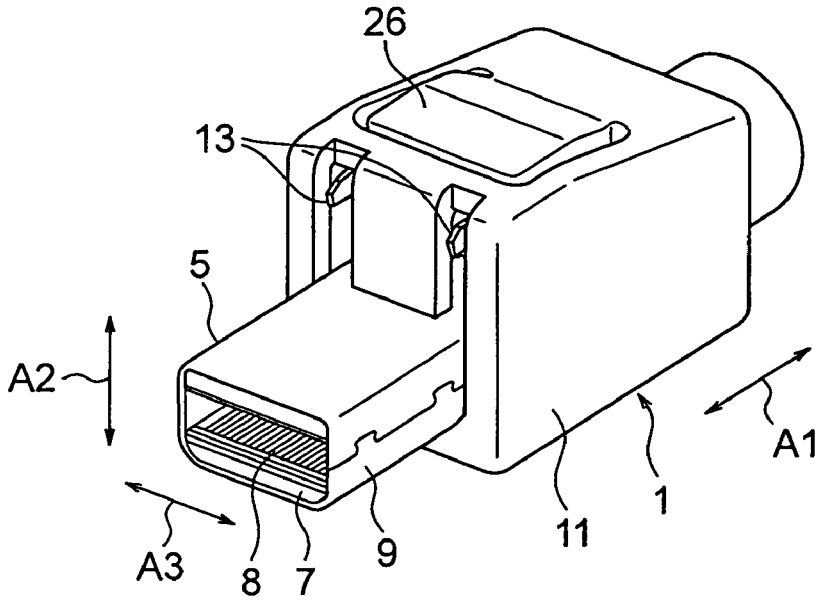
FIG. 4 is a perspective view of the plug included in the connecting device shown in FIGS. 1 and 2.
Figure 5:
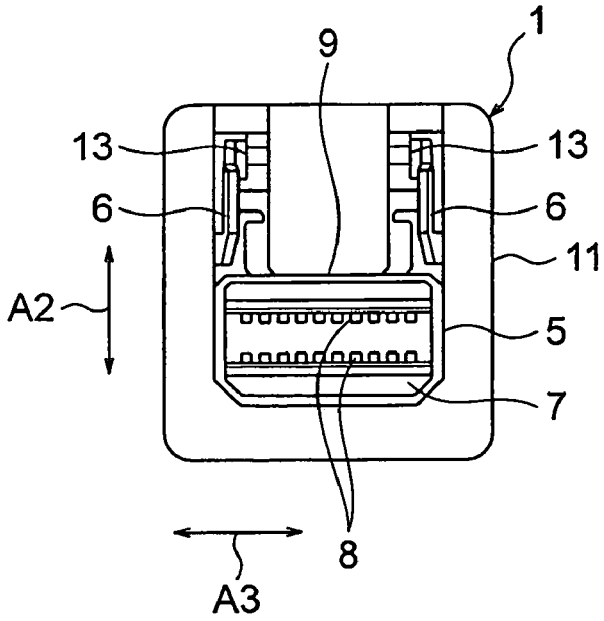
FIG. 5 is a front view of the plug of FIG. 4.
Figure 6:
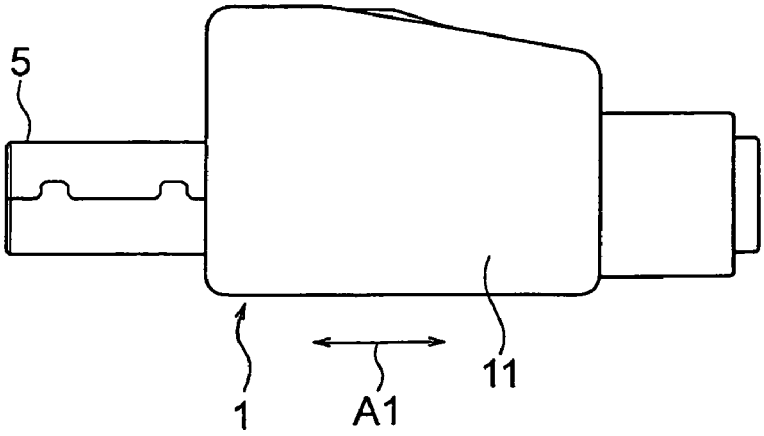
FIG. 6 is a side view of the plug of FIG. 4.

The connecting device shown in FIGS. 1 and 2 includes a plug 1 as a mating connector and a receptacle 2 as the present connector which is connectable to or disconnectable from the plug 1 in a first direction A1. The receptacle 2 is placed on a board 3 and fixed to a panel 4 of a device housing or the like serving as an attaching object.

In FIGS. 3 to 6, the plug 1 includes a fitting portion 5 and a pair of locking levers 6 located outside the fitting portion 5 in a second direction A2 perpendicular to the first direction A1. The fitting portion 5 includes an insulating plug-side inner housing 7, a plurality of conductive plug-side contacts 8 arranged in the plug-side inner housing 7 in a third direction A3 perpendicular to the first and second directions A1 and A2, and a hollow rectangular parallelepiped conductive plug-side shell 9 covering the outside of the plug-side inner housing 7.

The plug 1 further includes an insulating plug-side outer housing 11 receiving and holding the fitting portion 5. Electric wires of a shielded cable (not illustrated) are connected to the plug-side contacts 8, respectively, while shielding wires of the shielded cable are connected to the plug-side shell 9. The shielded cable is brought out to the outside of the plug 1.

The pair of locking levers 6 have conductivity and elasticity and are disposed in the plug-side outer housing 11 and electrically and mechanically connected to the plug-side shell 9. The pair of locking levers 6 each have at its front end portion an engaging claw 13 that is engageable with the receptacle 2 in the first direction A1. The engaging claws 13 are located inside the plug-side outer housing 11. On the other hand, the fitting portion 5 projects outside the plug-side outer housing 11 in the first direction A1. Herein, the pair of locking levers 6 are collectively called a locking portion.

Figure 7:
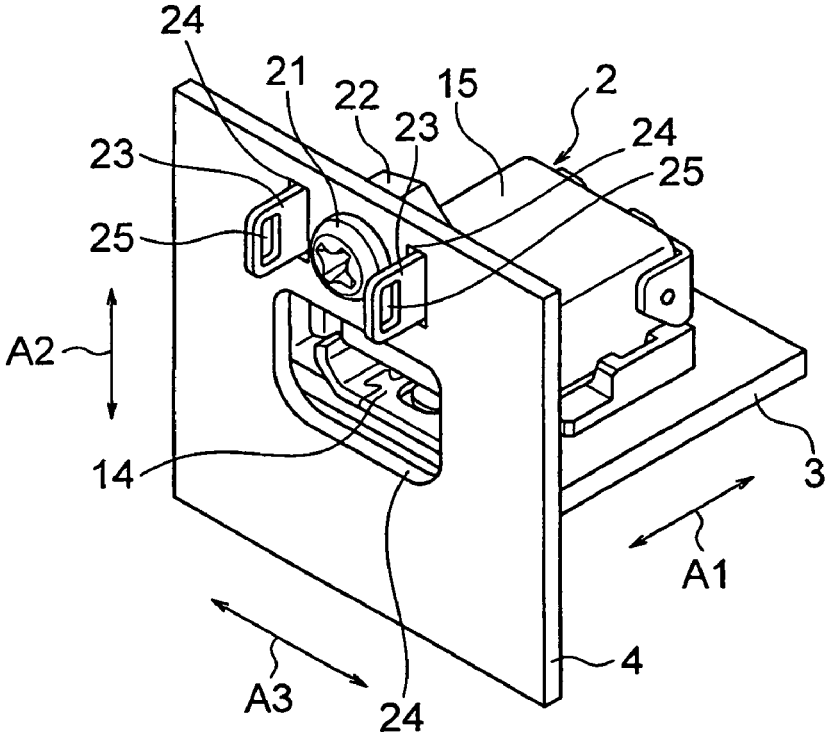
FIG. 7 is a perspective view showing a state where a receptacle included in the connecting device shown in FIGS. 1 and 2 is attached to an attaching object.
Figure 8:
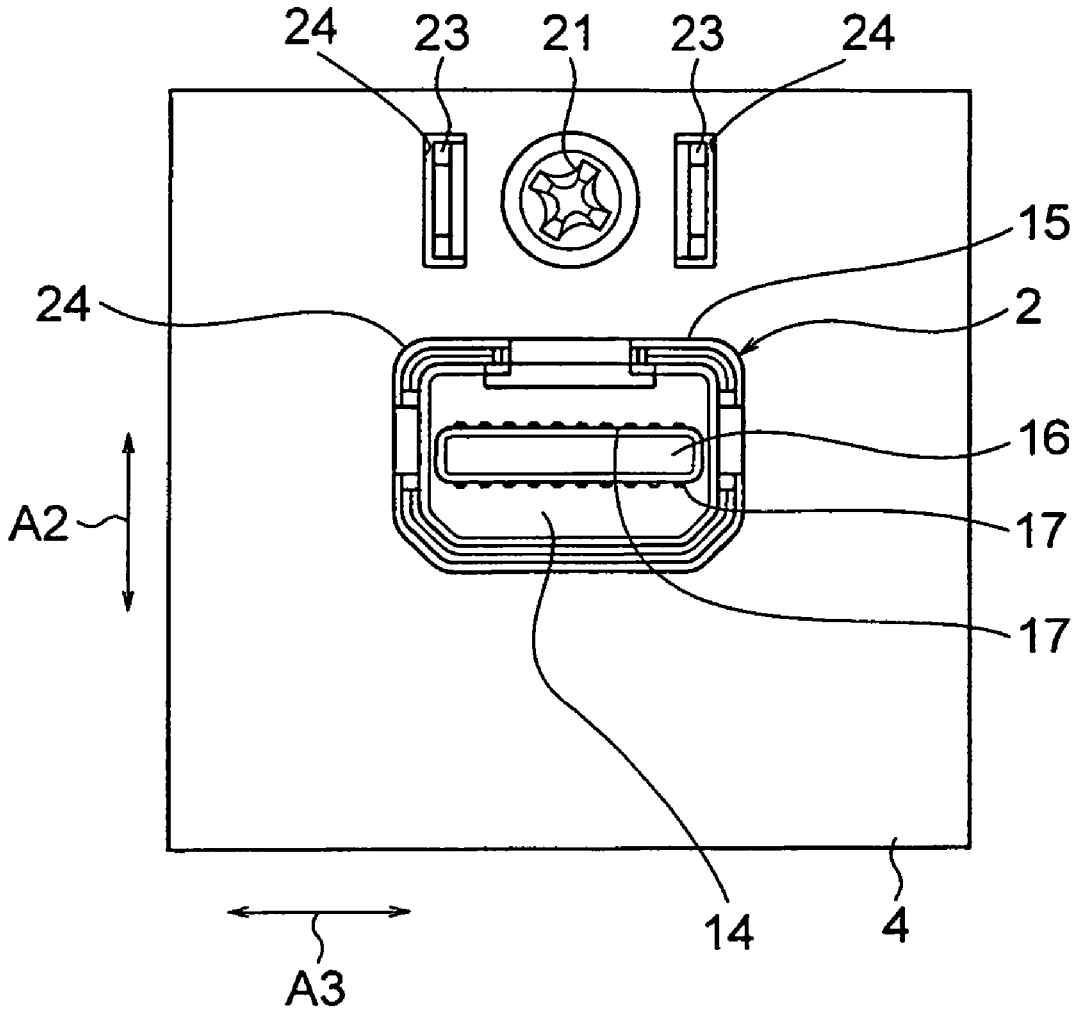
FIG. 8 is a front view of the receptacle in the state of FIG. 7.
Figure 9:
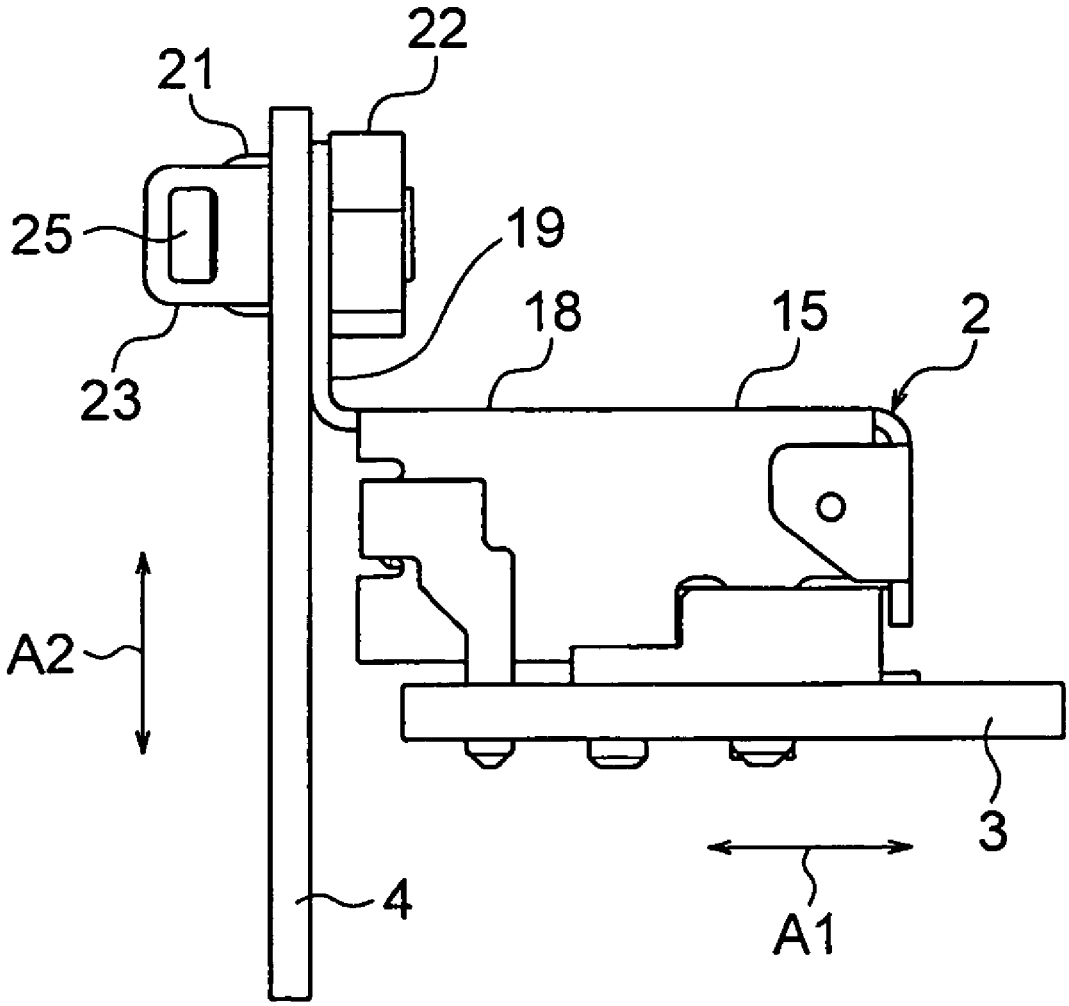
FIG. 9 is a side view of the receptacle in the state of FIG. 7.

In FIGS. 7 to 9, the receptacle 2 includes a to-be-fitted portion 14 that can be fitted to the fitting portion 5 in the first direction A1, and a conductive receptacle-side shell 15 covering the to-be-fitted portion 14. The to-be-fitted portion 14 includes an insulating receptacle-side housing 16 and a plurality of conductive receptacle-side contacts 17 arranged on the receptacle-side housing 16 in the third direction A3. At least one of the receptacle-side contacts 17 is connected to a ground circuit (not illustrated) of the board 3.

The receptacle-side shell 15 integrally includes a flange 19 extending in the second direction A2 from one end, in the first direction A1, of a shell body 18. The flange 19 faces one surface, i.e. a rear surface, of the panel 4 in the first direction A1 and is firmly fixed to the panel 4 by means of a bolt 21 and a nut 22.

The receptacle-side shell 15 further includes a pair of parallel locking pieces 23 extending in the first direction A1 from both side edges, in the third direction A3, of the flange 19. Each locking piece 23 has a plate shape extending in the first and second directions A1 and A2 and passes through the panel 4 on one side, in the second direction A2, of a connection opening 24 formed in the panel 4, so as to project in the first direction A1 from the opposite surface, i.e. a front surface, of the panel 4. Each locking piece 23 is formed, at its portion projecting from the front surface of the panel 4, with an engaging opening 25 penetrating in the third direction A3. Herein, the pair of locking pieces 23 are collectively called a to-be-locked portion.

Now, the operation of the above-mentioned connecting device will be described.

The receptacle 2 fixed to the rear surface of the panel 4 is positioned so that the to-be-fitted portion 14 faces the connection opening 24 of the panel 4. In order to connect the plug 1 to the receptacle 2, the fitting portion 5 of the plug 1 is caused to pass through the connection opening 24 from the front surface side of the panel 4 so as to be fitted to the to-be-fitted portion 14 of the receptacle 2. This causes the plug-side contacts 8 to be brought into contact with the receptacle-side contacts 17, thereby obtaining a desired state where the plug 1 and the receptacle 2 are electrically connected to each other.

When the plug 1 and the receptacle 2 are brought into the desired state as described above, the plug-side outer housing 11 covers the portions, projecting from the panel 4, of the locking pieces 23. Simultaneously, the engaging claws 13 of the locking levers 6 engage with the edges of the engaging openings 25 of the locking pieces 23 in the first direction A1 so that the plug 1 is prevented from being disconnected from the receptacle 2. That is, the plug 1 and the receptacle 2 are mechanically connected to each other.

By depressing an operating lever 26 formed as a part of the plug-side outer housing 11, it is possible to release the engagement between the locking levers 6 and the locking pieces 23. Accordingly, the plug 1 can be easily disconnected from the receptacle 2.

According to the connecting device described above with reference to FIGS. 1 to 9, since the locking levers 6 and the locking pieces 23 are provided outside the fitting portion 5 and the to-be-fitted portion 14 that serve as the connecting portions of the connectors, even if the connectors are small in size, it is easy to improve the mechanical strength and the locking strength of the locking levers 6 and the locking pieces 23. Further, it is also possible to prevent degradation of the electrical properties by minimizing the size of the connection opening 24 that is formed in the panel 4.

Figure 10:
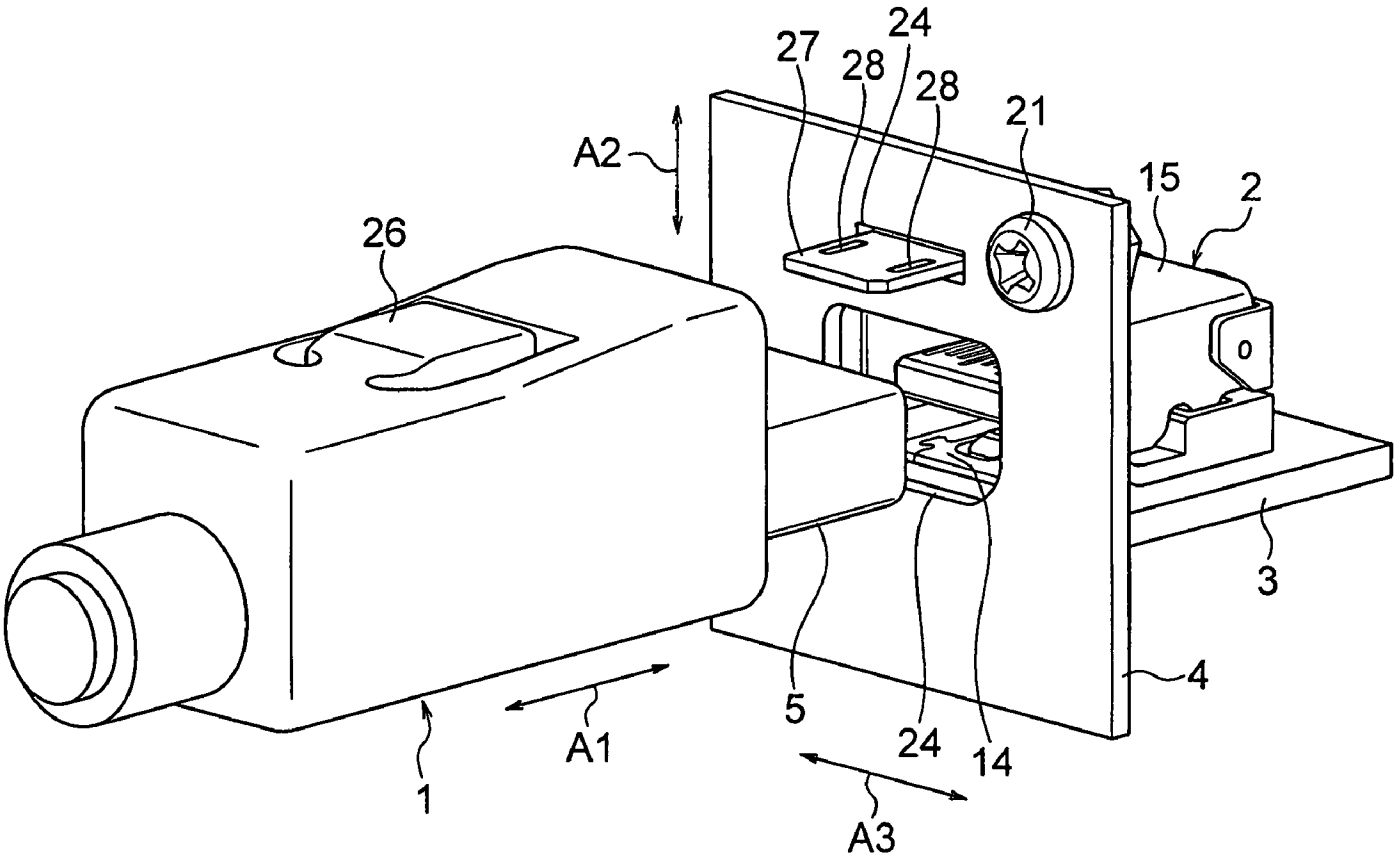
FIG. 10 is a perspective view of a connecting device according to a second embodiment of this invention.
Figure 11:
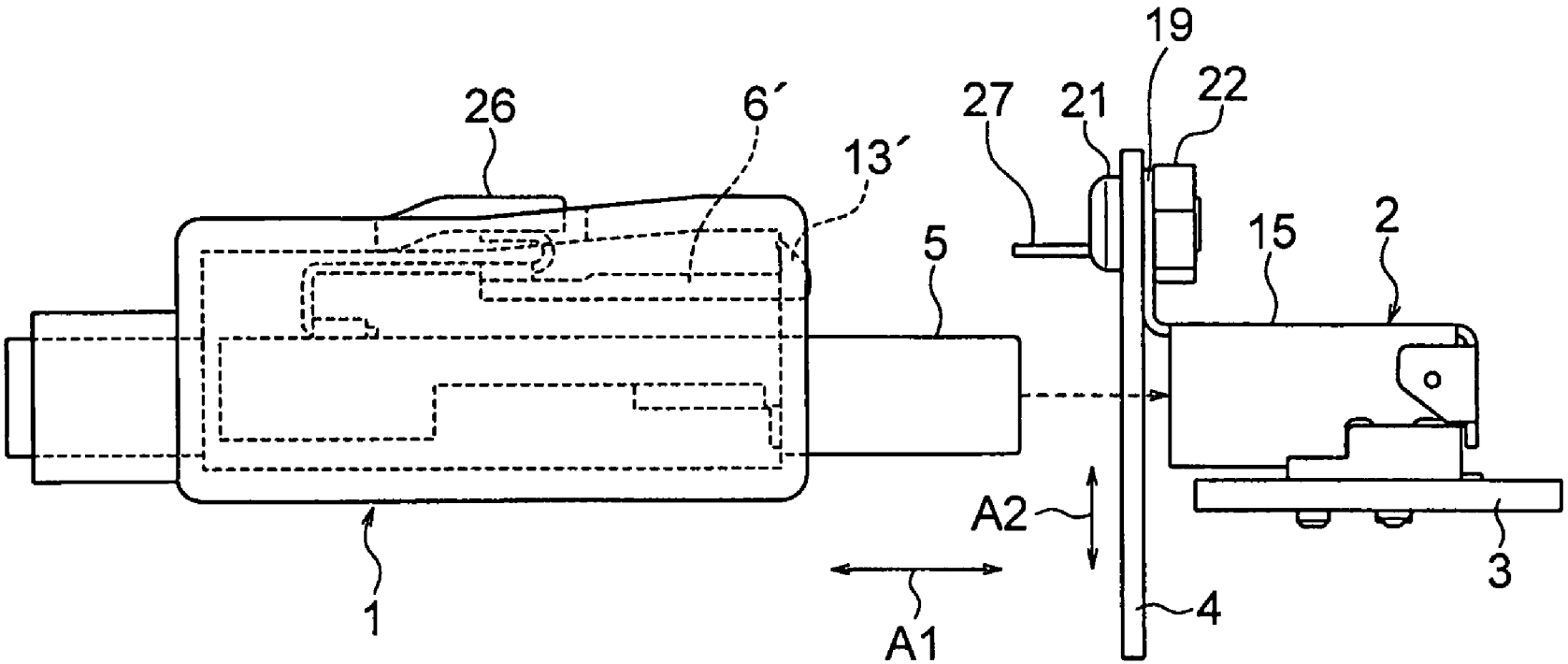
FIG. 11 is a side view of the connecting device of FIG. 10.
Figure 12:
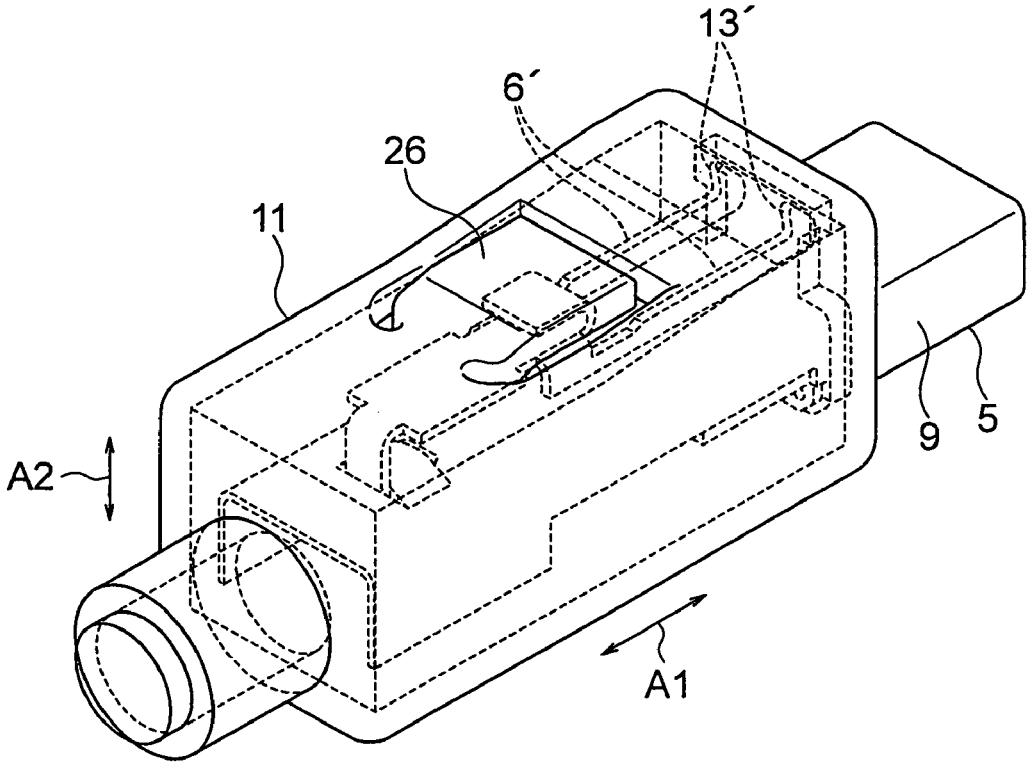
FIG. 12 is a perspective view of a plug included in the connecting device of FIG. 10.

Referring to FIGS. 10 to 12, a connecting device according to a second embodiment of this invention will be described. The same reference symbols are assigned to the same or similar portions as those described above, thereby omitting an explanation thereof.

In the connecting device shown in FIGS. 10 and 11, a receptacle-side shell 15 of a receptacle 2 includes a single locking piece 27 extending in the first direction A1 from an end edge, in the second direction A2, of a flange 19. The locking piece 27 has a plate shape extending in the first and third directions A1 and A3 and passes through a panel 4 on one side, in the second direction A2, of a connection opening 24 formed in the panel 4, so as to project in the first direction A1 from a front surface of the panel 4. The locking piece 27 is formed, at its portion projecting from the front surface of the panel 4, with two engaging openings 28 each penetrating in the second direction A2. The number of the engaging openings 28 is optional and may be one.

The receptacle 2 is fixed to a rear surface of the panel 4 and is positioned so that its to-be-fitted portion 14 faces the connection opening 24 of the panel 4, which is the same as in the connecting device described with reference to FIGS. 1 to 9. Also likewise, by causing a fitting portion 5 of a plug 1 to pass through the connection opening 24 from the front surface side of the panel 4 so as to be fitted to the to-be-fitted portion 14 of the receptacle 2, a desired state is obtained where the plug 1 and the receptacle 2 are electrically connected to each other.

When the plug 1 and the receptacle 2 are brought into the desired state as described above, a plug-side outer housing 11 covers the portion, projecting from the panel 4, of the locking piece 27. Simultaneously, engaging claws 13' of two locking levers 6' engage with the edges of the two engaging openings 28 of the locking piece 27 in the first direction A1 so that the plug 1 is prevented from being disconnected from the receptacle 2. That is, the plug 1 and the receptacle 2 are mechanically connected to each other. In this case, the single locking piece 27 serves as a to-be-locked portion like the pair of locking pieces 23.

By depressing an operating lever 26 formed as a part of the plug-side outer housing 11, it is possible to release the engagement between the locking levers 6' and the locking piece 27. Accordingly, the plug 1 can be easily disconnected from the receptacle 2.

Also according to the connecting device described above with reference to FIGS. 10 to 12, it is easy to improve the mechanical strength and the locking strength of the locking levers 6' and the locking piece 27. Further, it is also possible to prevent degradation of the electrical properties by minimizing the size of the connection opening 24 that is formed in the panel 4.

Figure 13:
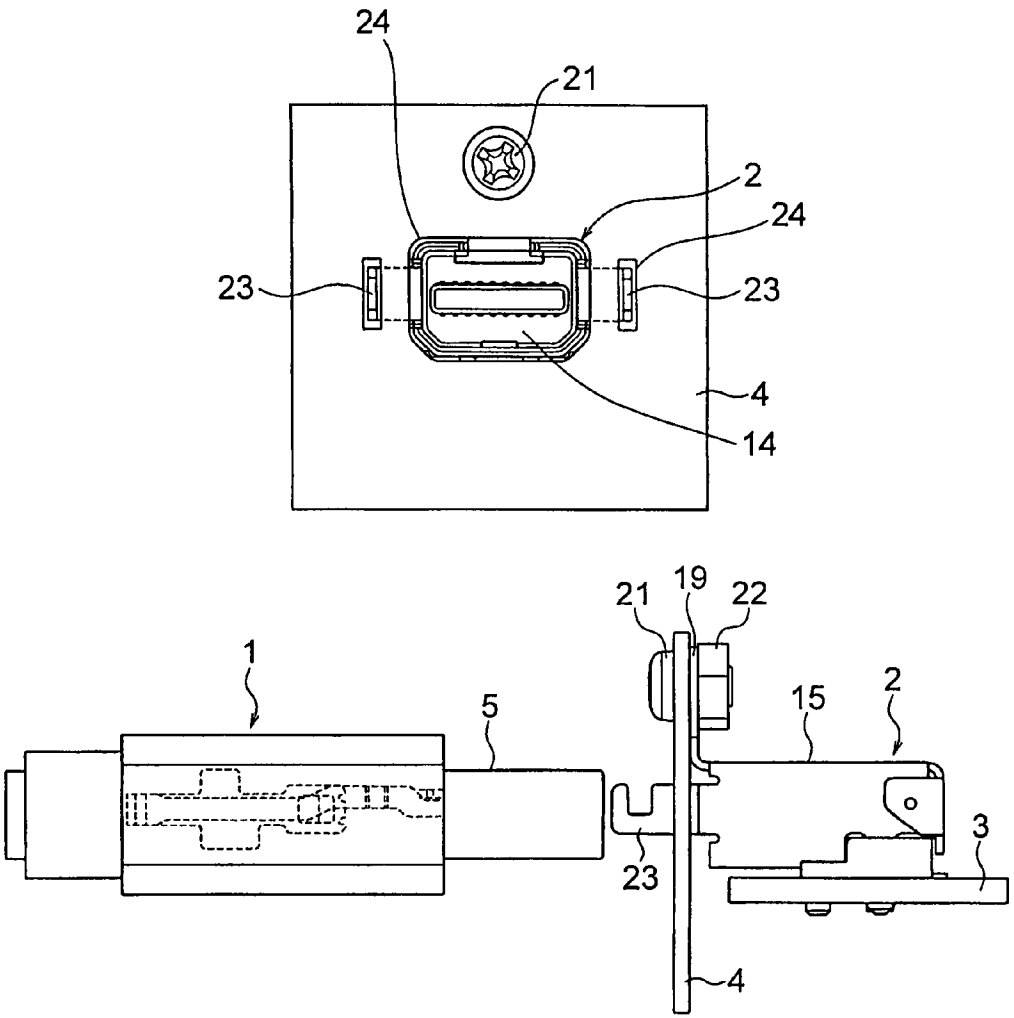
FIG. 13 is a front view and a side view of a connecting device according to a third embodiment of this invention.

Referring to FIG. 13, a connecting device according to a third embodiment of this invention will be described. The same reference symbols are assigned to the same or similar portions as those described above, thereby omitting an explanation thereof.

The connecting device shown in FIG. 13 differs from the first and second embodiments in that a pair of locking pieces 23 are located on both sides, in a contact arranging direction, i.e. in the third direction A3, of a connection opening 24 of a panel 4.

In the third embodiment, each locking piece 23 may have an opening such as the engaging opening 25 or 28, or a cutout as shown in FIG. 13. Alternatively, each locking piece 23 may have the shape of the engaging claw 13 or 13' of the mating connector (in this case, the mating connector has a corresponding locking hole or the like). In this manner, each locking piece 23 may have any appropriate shape.

According to the connectors of the first to third embodiments, the locking structure can be formed regardless of the sizes of the fitting portion and the to-be-fitted portion. Therefore, it is possible to provide the connector having the flange for attachment to the panel, which can improve the mechanical strength and the locking strength without causing degradation of the electrical properties.

The whole or part of the exemplary embodiments disclosed above can be described as, but not limited to, the following supplementary notes.

(Supplementary note 1) A connector comprising:

a to-be-fitted portion for fitting to a mating connector in a first direction; and a shell which is conductive and covers the to-be-fitted portion, wherein the shell comprises:

a flange which extends in a second direction crossing the first direction and is adapted to face an attaching object in the first direction; and a to-be-locked portion for engagement with the mating connector in the first direction, the to-be-locked portion extending in a direction to pass through the attaching object in the first direction.

(Supplementary note 2). The connector according to supplementary note 1, wherein the flange extends outside as seen from the to-be-fitted portion and the to-be-locked portion extends from the flange.

(Supplementary note 3). The connector according to supplementary note 1 or 2, wherein the to-be-fitted portion comprises:

a conductive contact; and an insulating housing which holds the contact, wherein the shell further comprises a shell body which covers the contact and the housing, and the flange extends from one end, in the first direction, of the shell body, the one end adapted to face the mating connector.

(Supplementary note 4). The connector according to anyone of supplementary notes 1-3, wherein the to-be-locked portion comprises a pair of to-be-locked pieces each projecting from a surface, adapted to face the attaching object, of the flange and each of the pair of to-be-locked pieces has a to-be-engaged portion which is engageable with the mating connector in the first direction.

(Supplementary note 5). The connector according to anyone of supplementary notes 1-3, wherein the to-be-locked portion comprises a single to-be-locked piece projecting from a surface, adapted to face the attaching object, of the flange and the to-be-locked piece has a pair of to-be-engaged portions each engageable with the mating connector in the first direction.

(Supplementary note 6). The connector according to anyone of supplementary notes 1-5, further comprising fixing means for fixing the flange to the attaching object.

(Supplementary note 7). A mating connector for connection to the connector according to anyone of supplementary notes 1-6, wherein the mating connector comprises:

a fitting portion for fitting to the to-be-fitted portion; and a locking portion for engagement with the to-be-locked portion, the locking portion located outside the fitting portion in the second direction.

(Supplementary note 8). A connector fixed to an attaching object, wherein the connector comprises:

a to-be-fitted portion for fitting to a mating connector in a first direction; and a shell which is conductive and covers the to-be-fitted portion, wherein the shell comprises:

a flange which extends in a second direction crossing the first direction and faces a surface of the attaching object in the first direction; and a to-be-locked portion for engagement with the mating connector, the to-be-locked portion passing through the attaching object in the first direction to project from an opposite surface of the attaching object.

(Supplementary note 9). A mating connector for connection to the connector according to supplementary note 8, wherein the mating connector comprises:

a fitting portion for fitting to the to-be-fitted portion; and a locking portion for engagement with the to-be-locked portion, the locking portion located outside the fitting portion in the second direction.

While this invention has been described with reference to the embodiments, this invention is not limited thereto. Various changes that can be understood by a person skilled in the art can be made to the structures and details of this invention within the scope of this invention.

What is claimed is:

1. A connector comprising:

a to-be-fitted portion for fitting to a mating connector in a first direction; and a shell which is conductive and covers the to-be-fitted portion, wherein the shell comprises:

a flange which extends from one end of the to-be-fitted portion outside the to-be-fitted portion in a second direction crossing the first direction and is adapted to face an attaching object in the first direction, the one end of the to-be-fitted portion being faced to the mating connector when connecting the connector to the mating connector; and a to-be-locked portion for engagement with the mating connector in the first direction, the to-be-locked portion being formed integral with the flange, the to-be-locked portion and the to-be-fitted portion extending opposite to each other form the flange in the first direction.

2. The connector according to claim 1, wherein the to-be-fitted portion comprises:

a conductive contact; and an insulating housing which holds the contact, wherein the shell further comprises a shell body which covers the contact and the housing, and the flange extends in the second direction from one end of the shell body, the one end of the shell body being adapted to face the mating connector.

3. The connector according to claim 1, wherein the to-be-locked portion comprises a pair of locking pieces each projecting from the flange towards the mating connector and each of the pair of locking pieces has a to-be-engaged portion which is engageable with the mating connector in the first direction.

4. The connector according to claim 1, wherein the to-be-locked portion comprises a single locking piece projecting from a surface, adapted to face the attaching object, of the flange and the locking piece has a pair of to-be-engaged portions each engageable with the mating connector in the first direction.

5. The connector according to claim 1, further comprising fixing means for fixing the flange to the attaching object.

6. A mating connector for connection to the connector according to claim 1, wherein the mating connector comprises:

a fitting portion for fitting to the to-be-fitted portion; and a locking portion for engagement with the to-be-locked portion, the locking portion located outside the fitting portion in the second direction.

7. A connector fixed to an attaching object, wherein the connector comprises:

a to-be-fitted portion for fitting to a mating connector in a first direction; and a shell which is conductive and covers the to-be-fitted portion, wherein the shell comprises:

a flange which extends from one end of the to-be-fitted portion outside the to-be-fitted portion in a second direction crossing the first direction and faces a surface of the attaching object in the first direction, the one of the to-be-fitted portion being faced to the mating connector when connecting the connector to the mating connector; and a to-be-locked portion for engagement with the mating connector, the to-be-locked portion being formed integral with the flange and extending from the flange to pass through the attaching object in the first direction to project from an opposite surface of the attaching object, the to-be-fitted portion extending opposite to the to-be-locked portion form the flange to be apart from the attaching object in the first direction.

8. A mating connector for connection to the connector according to claim 7, wherein the mating connector comprises:

a fitting portion for fitting to the to-be-fitted portion; and a locking portion for engagement with the to-be-locked portion, the locking portion located outside the fitting portion in the second direction.

* * * * *

UNITED STATES PATENT AND TRADEMARK OFFICE

CERTIFICATE OF CORRECTION

PATENT NO. : 8,403,696 B2
APPLICATION NO. : 12/925161
DATED : March 26, 2013
INVENTOR(S) : Katayanagi et al.

It is certified that error appears in the above-identified patent and that said Letters Patent is hereby corrected as shown below:

In the Claims:

In Column 6, line 66, Claim 1, please change "form" to correctly read: --from--.

In Column 8, line 21, Claim 7, please change "form" to correctly read: --from--.

Signed and Sealed this
Eighteenth Day of June, 2013

Teresa Stanek Rea
*Acting Director of the United States Patent and Trademark Office*